US005904577A

United States Patent [19]

Swanson et al.

[11] Patent Number: 5,904,577

[45] Date of Patent: May 18, 1999

[54] SEPARABLE, FLEXIBLE ELECTRICAL CONNECTION ARRANGEMENT

[75] Inventors: Roy T. Swanson, La Grange Park; Buddy B. McGlone, Lombard; John C. Opfer, Chicago, all of Ill.

[73] Assignee: S&C Electric Company, Chicago, Ill.

[21] Appl. No.: 08/811,310

[22] Filed: Mar. 4, 1997

[51] Int. Cl.[6] ..... H01R 35/04

[52] U.S. Cl. ..... 439/8; 174/86

[58] Field of Search ..... 174/153 R, 86; 439/6, 8, 9, 13, 31–33

[56] References Cited

U.S. PATENT DOCUMENTS

| | | | |
|---|---|---|---|
| 497,732 | 5/1893 | Stupakoff | 174/153 R |
| 1,076,032 | 10/1913 | Gilling | 439/9 |
| 1,213,632 | 1/1917 | Hammond | 439/860 |
| 1,657,253 | 1/1928 | Fortin | 174/153 R |
| 2,430,270 | 4/1947 | Bergan | 439/9 |
| 2,613,245 | 10/1952 | Broulette | 439/323 |
| 3,008,117 | 11/1961 | Feustel et al. | 439/439 |
| 3,011,144 | 11/1961 | Armentrout | 439/435 |
| 3,842,187 | 10/1974 | Barkan | 439/8 |
| 4,120,555 | 10/1978 | Shiflett et al. . | |
| 4,767,351 | 8/1988 | Patel | 439/363 |
| 4,964,807 | 10/1990 | Draus | 439/829 |
| 5,709,553 | 1/1998 | Opfer et al. | 439/6 |

FOREIGN PATENT DOCUMENTS

| | | | |
|---|---|---|---|
| 0266247 | 7/1929 | Italy | 439/8 |

*Primary Examiner*—Neil Abrams
*Attorney, Agent, or Firm*—James V. Lapacek

[57] ABSTRACT

A separable, flexible connection arrangement (10) is provided for connection of two conductors (12, 14). In one arrangement, the separable, flexible connection arrangement (10) is utilized to provide an externally removable bushing (16) for connecting an electrical component located within a sealed enclosure (19). The flexible connection arrangement (10) includes two joints (20, 22) formed by two link members (50*a*, 50*b*) that are spring-biased and include protuberances (40, 42) that interfit into slots (30, 32) of the conductors (12, 14). A spacer (72) may be used to maintain spacing of the protuberances (40, 42) and also acts as a stop when contacted by the ends of the slots (30, 32). One of the slots (32) is formed with an open end (74) to enable easy insertion between the link members (50*a*, 50*b*). Alternatively, one of the conductors (100) includes a set of grooves (102, 104).

7 Claims, 5 Drawing Sheets

SEPARABLE, FLEXIBLE ELECTRICAL CONNECTION ARRANGEMENT

CROSS REFERENCE TO RELATED APPLICATION

This application is directed to improvements of the arrangement of application Ser. No. 08/713,940 filed Sep. 11, 1996 in the names of B. B. McGlone et al. now U.S. Pat. No. 5,709,553.

BACKGROUND OF THE INVENTION

1. Field of the Invention

The present invention relates generally to flexible connections and more particularly to an externally removable bushing that provides a flexible connection to components located within a switchgear.

2. Description of the Related Art

Switchgear for electrical power distribution systems commonly include enclosures defining contained environment desirable for circuit-interrupting functions of the enclosed components. In order to connect the enclosed components to external power cables, a bushing is utilized to provide a conductor through the sealed enclosure of the switchgear and to insulate the conductor from the enclosure. The bushing typically includes provisions for assembly with separable connectors which interface between the bushing and the power cables. The external portions of the bushing are subject to damage which may render the bushing unusable, requiring replacement of the bushing. This requires disconnection of the bushing from the enclosed components. If this disconnection of the bushing requires opening of the enclosure, the replacement of the bushing is not only time-consuming and difficult to perform in confined spaces, the design of the switchgear enclosure is also complicated thereby since opening features must be incorporated.

A prior arrangement shown in U.S. Pat. No. 4,767,351 provides an externally-separable bushing such that connection and disconnection to enclosed components may be accomplished external to the enclosure and not requiring opening of the enclosure. The conductor of that bushing arrangement includes a cylindrical rod which is permanently and rigidly attached to the enclosed component and a sleeve with annular passage that receives the rod. The bushing also includes provisions for threadably connecting the two conductor parts. Thus, the bushing is removed by unthreading of the bushing from the cylindrical conductor such that the remainder of the bushing may be removed. This arrangement also requires provisions for sealing the junction of the two conductor parts.

While the prior art arrangements may be useful to provide connections to enclosed electrical components, these prior arrangements are either not externally replaceable or are complicated to manufacture and use.

SUMMARY OF THE INVENTION

Accordingly, it is a principal object of the present invention to provide an externally removable bushing connector that provides connection to an electrical component located within a switchgear enclosure while providing ease of use and a flexible connection to the electrical component.

It is another object of the present invention to provide a separable, flexible connection arrangement between two conductors that is slidable, rotatable, twistable and translatable when connected and that is easily separable to disconnect the two conductors.

These and other objects of the present invention are efficiently achieved by the provision of a separable, flexible connection arrangement for two conductors. In one arrangement, the separable, flexible connection arrangement is utilized to provide an externally removable bushing for connecting an electrical component located within a sealed enclosure.

BRIEF DESCRIPTION OF THE DRAWING

The invention, both as to its organization and method of operation, together with further objects and advantages thereof, will best be understood by reference to the specification taken in conjunction with the accompanying drawing in which.

DETAILED DESCRIPTION

Figure 1:
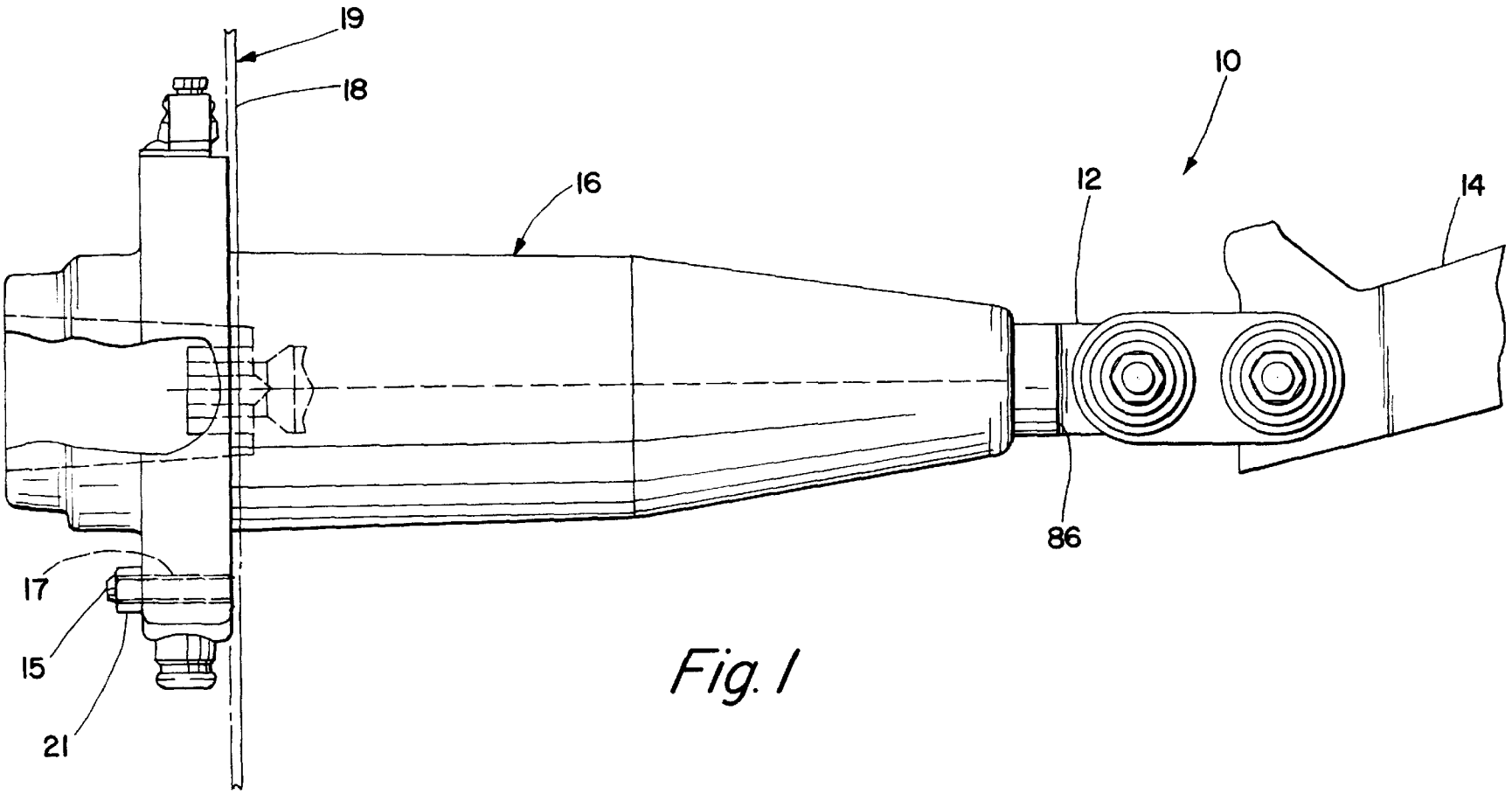
FIG. 1 is a front elevational view of the connection arrangement of the present invention depicting a connected position.
Figure 2:
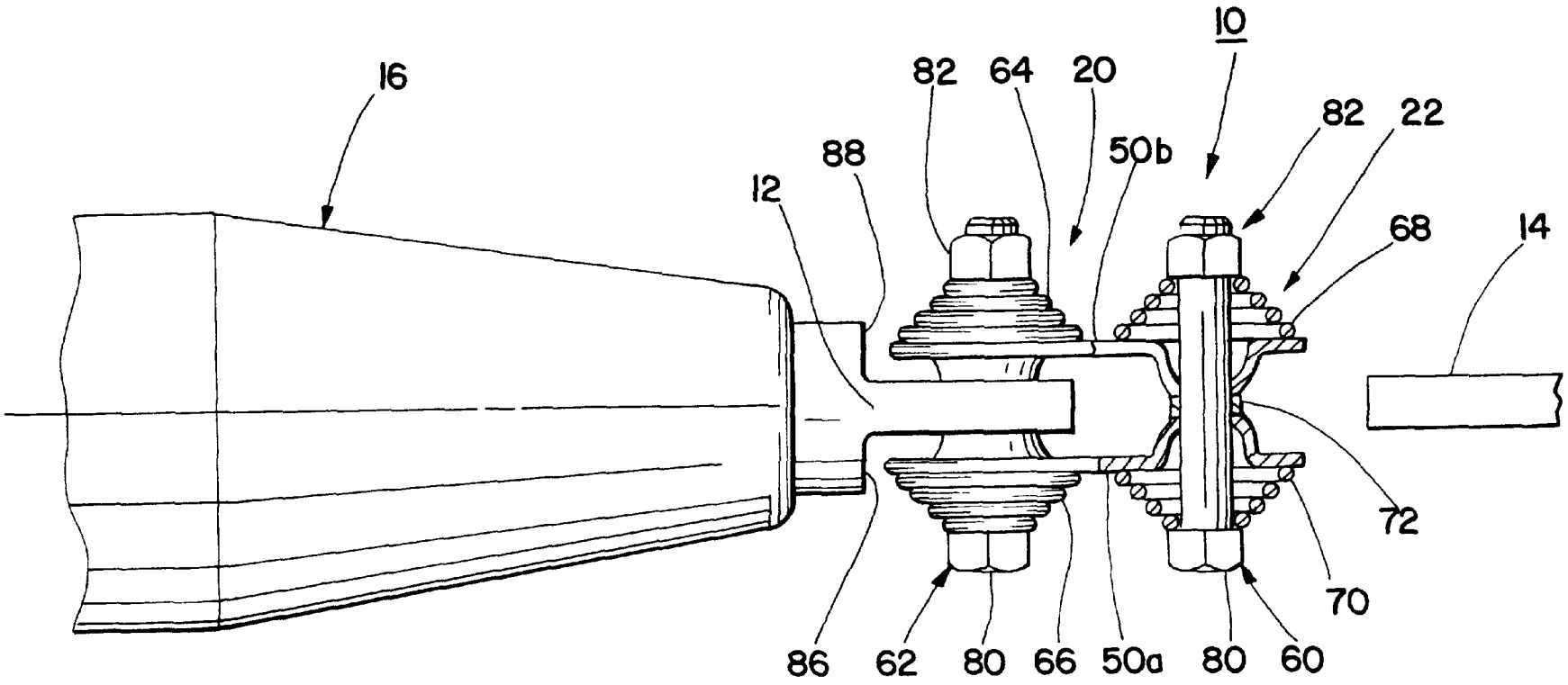
FIG. 2 is a top plan view of FIG. 1 but depicting a disconnected position.

Referring now to FIGS. 1–2, the connection arrangement 10 of the present invention provides a separable, flexible electrical connection between two conductors 12, 14. In a specific illustration as shown in FIGS. 1 and 2, the conductor 12 of the connection arrangement 10 is the conductor of a bushing 16 that is externally removable with respect to a wall 18 of an enclosure 19. The conductor 14 provides electrical connection to an electrical component (not shown) housed in the enclosure 19. The bushing 16 is removable from the wall 18 via a fastening arrangement, e.g. threaded studs 15 extending from the wall 18 and through apertures 17 in the bushing 16 that cooperate with nuts 21 affixed over the threaded studs 15. Thus, when the bushing 16 is unfastened from the wall 18, the bushing 16 may be disconnected from the conductor 14 and removed for replacement etc.

Figure 3:
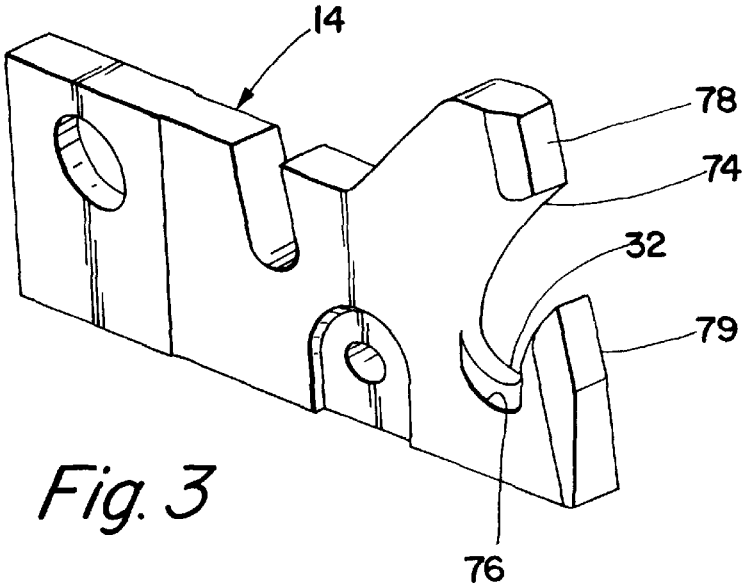
FIGS. 3–5 are respective perspective, front elevational, and top plan views of a first conductor of the connection arrangement of FIGS. 1 and 2.
Figure 4:
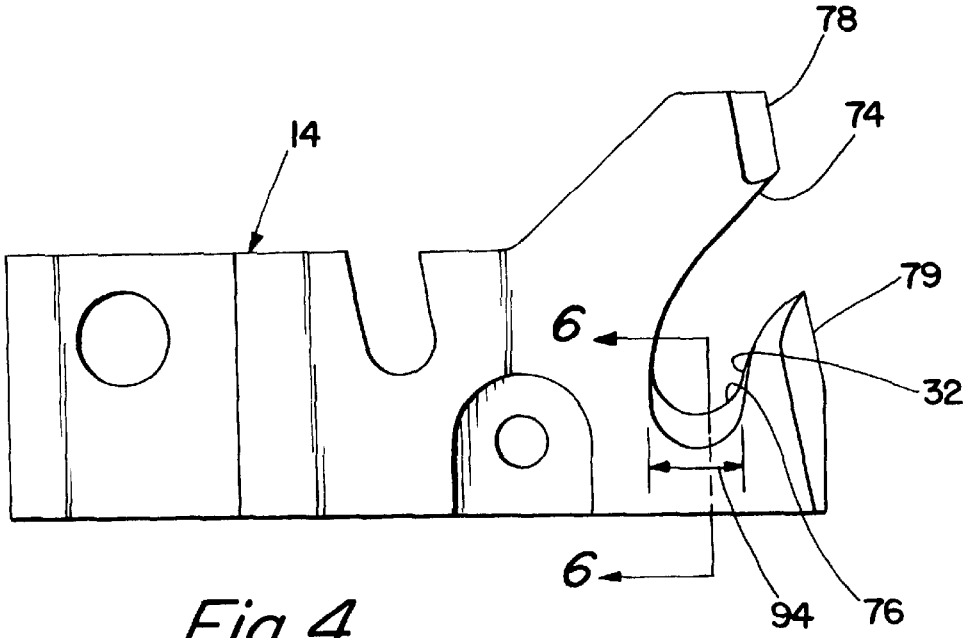
Figure 5:
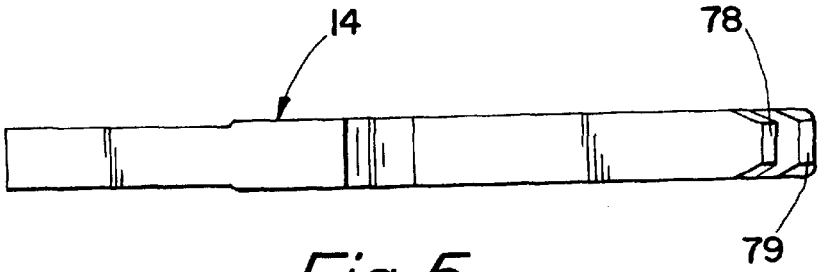
Figure 6:
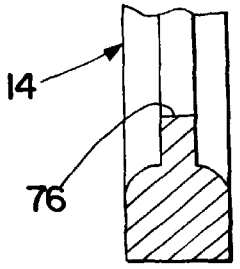
FIG. 6 is a sectional view taken along line 6—6 of FIG. 4.
Figure 10:
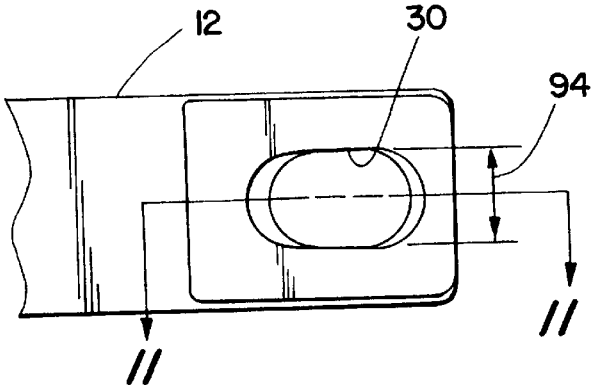
FIG. 10 is a partial perspective view of a second conductor of the connection arrangement of FIGS. 1 and 2.
Figure 11:
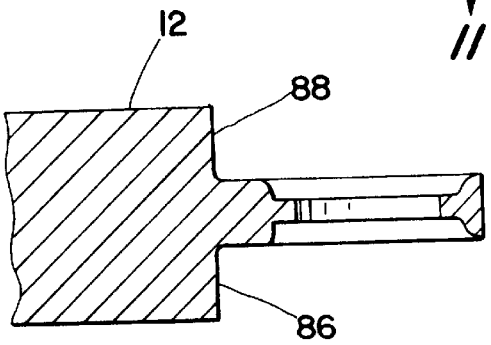
FIG. 11 is a sectional view taken along the line 11—11 of FIG. 10.

The connection arrangement 10 includes two joints 20, 22, a first of the two joints 20 making electrical connection with the conductor 12 and the second of the two joints 22 being arranged for separable connection with the conductor 14. The detailed features of the conductor 14 are illustrated with additional reference to FIGS. 3–6, and the detailed features of the conductor 12 are illustrated with additional reference to FIGS. 10 and 11. Each of the two joints 20, 22 includes two surfaces that face each other and are disposed on opposite sides of the respective conductor 12, 14 about a slotted portion 30 of the conductor 12 (seen in FIGS. 10 and 11) and a slotted portion 32 of the conductor 14 (seen in FIGS. 3, 4 and 6).

Figure 7:
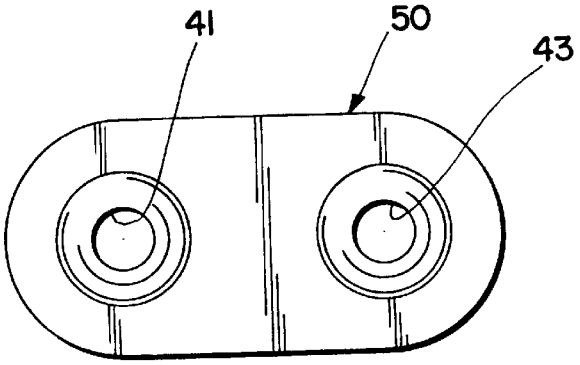
FIGS. 7–9 are respective front, top and right-side elevational views of a link member of the connection arrangement of FIGS. 1 and 2.
Figure 9:
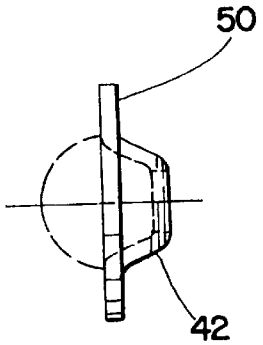
Figure 8:
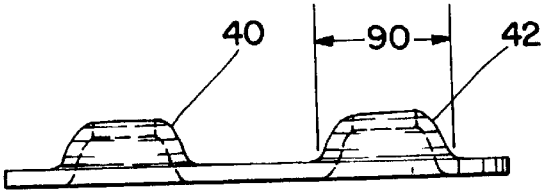

In a preferred embodiment, the surfaces of the joints 20, 22 are portions of generally spherical surfaces. In the specific arrangement illustrated in FIGS. 1 and 2, and referring additionally now to FIGS. 7–9, the joints 20, 22 are formed by protuberances 40, 42 on a link member 50, the protuberances 40, 42 being generally spherical portions that are approximate hemispheres. Specifically, two of the link members 50*a,* 50*b* are positioned such that the protuberances 40 and 42 of each link member 50*a,* 50*b* face each other. Each of the protuberances 40, 42 include respective central apertures 41, 43 formed therethrough. The link members 50*a,* 50*b* are assembled via fasteners 60, 62 and biasing members 64, 66, 68 and 70.

In the specific illustration, the biasing members 64, 66, 68 and 70 are conical springs and the fasteners 60, 62 are threaded bolts 80 cooperating with threaded nuts 82. For example, to form the joint 20, a bolt 80 is positioned through the conical spring 66, the aperture 41 of the link member 50*a,* through the slot 30 of the conductor 12, through the aperture 41 of the link member 50*b,* then through the conical spring 64, with the nut 82 threaded onto the bolt 80 and tightened so as to provide predetermined desirable compressive contact force between the slot 30 and the protuberances 40 of the spherical joint 20. The structure and assembly of the joint 22 is similar to that of the joint 20, except that a spacer 72 is provided between the protuberances 40 of each of the link members 50*a* and 50*b* and the joint 22 need not be assembled about the open slot 32 of the conductor 14.

The springs 64, 66, 68 and 70 are arranged to provide suitable contact force and allow the joints 20, 22 to move. Electromagnetic forces resulting from high currents through the connector arrangement 10 serve to pull the link members 50*a* and 50*b* together. These electromagnetic forces generally offset the localized point contact blow-off forces.

Referring now additionally to FIGS. 3–6, 10 and 11, the relative dimensions of the slots 30, 32 of the conductors 12, 14 and the external diameter of the protuberances 40, 42 of the link members 50 are arranged such that the external diameter 90 (FIG. 8) of the protuberances 40, 42 is somewhat larger than the width 94 of the slots 30, 32. The slots 30, 32 also include concave peripheral walls, i.e. flared outwardly, so as to provide suitable contact surfaces for the link members 50.

With specific reference now to FIGS. 1–6 and considering now the separable connection features of the connection arrangement 10 and the detailed features of the conductor 14, the arcuate shape of the open slot 32 of the conductor 14 along with the flexible provisions of the interconnection arrangement 10 provide the separable features of the interconnection arrangement and the specific application as an externally removable bushing 16. Specifically, the shape of the slot 32 guides the connection of the conductor 14 and the joint 22 such that the joint 22 enters the top 74 of the slot 32 and is guided along the arcuate slot 32 into the bottom 76 of the slot 32. Additionally, the conductor 14 along the leading edge thereof adjacent the slot 32 includes tapered edges 78 and 79 which further serve to guide the joint 22 into and along the slot 32 to the bottom of the slot 76. The spacer 72 in the joint 22 maintains the spacing of the spherical protuberances 42 such that a lower force of interconnection is established as compared to the situation where no spacer 72 is provided, i.e. the conductor 14 during interconnection operation does not need to initially spread the protuberances as far to establish connection. Further, in configurations that require relatively high forces to accomplish connection, in order to transmit the force of insertion through the bushing 16 to the flexible connection arrangement 10, the conductor 12 includes shoulders 86, 88 which are contacted by the pivot plates 50*a,* 50*b* as the joint 20 moves within the slot 30. The spacer 72, fabricated from non-conductive material and provided at each of the joints 20, 22, also serves as a stop when contacted by the ends of the slots 30, 32. This function assures that contact will be made, as desired, at two definite points on each of the protuberances 40, 42 at each of the joints 20, 22 (e.g. see F1G. 3 of the aforementioned application Ser. No. 08/713,940, now U.S. Pat No. 5,709,553).

Figure 12:
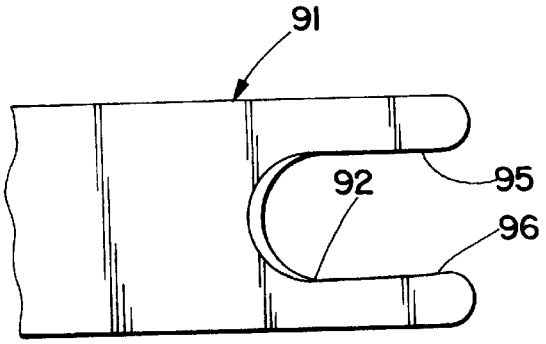
FIG. 12 is a front elevational view of a conductor in accordance with a second embodiment of the present invention.

In accordance with a second embodiment of the present invention and referring now additionally to FIG. 12, the conductor 91 with open slot 92 illustrates how the invention may be practiced with conductors having slots of various shapes and configurations, i.e. it should be realized that the conductors 14 and 91 are illustrative only and should not be interpreted in any limiting sense. While the conductor 14 is preferred due to the provided features of guidance and ease of connection, it should be realized that the present invention may be practiced with the simple open-ended slot 92 of the conductor 91. The open-ended slot 92 in a preferred arrangement includes tapered ends 95, 96 which define a tapered widened opening of the slot 92.

Figure 13:
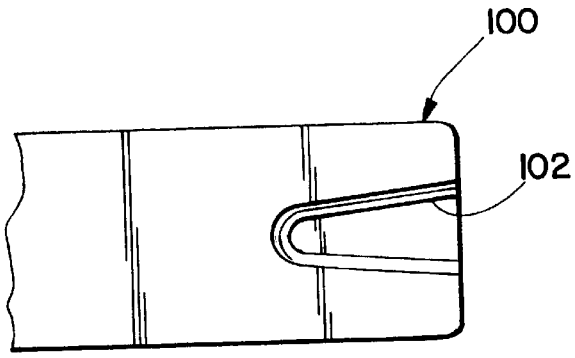
FIGS. 13 and 14 are respective front and right-side elevational views of a conductor in accordance with a third embodiment of the present invention.
Figure 14:
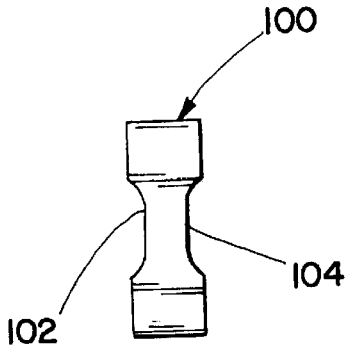
Figure 15:
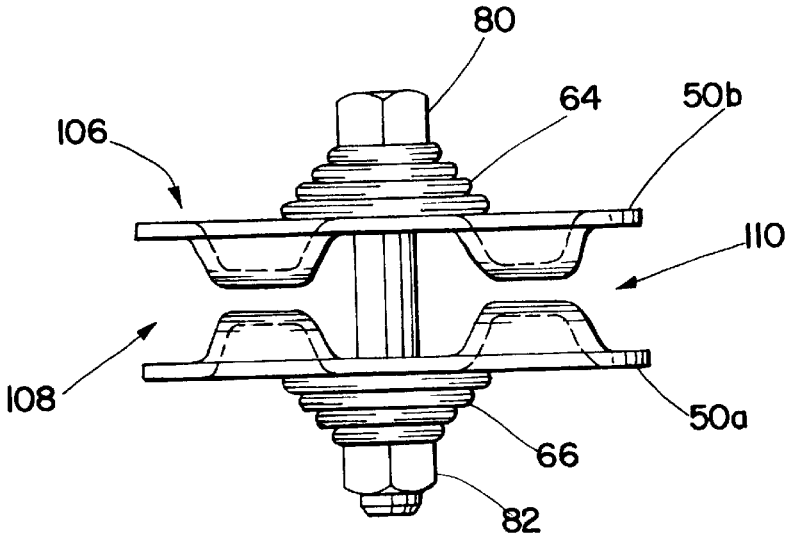
FIG. 15 is a top plan view of a connection arrangement in accordance with the third embodiment of the present invention for use with the conductor of FIGS. 13 and 14.

Referring now additionally to FIGS. 13–15 and considering now a third embodiment of the present invention, a conductor 100 includes tapered grooves 102, 104 on either side in lieu of the slots 30, 32 or 92. This embodiment illustrates that the present invention may be practiced with conductors having various contact engagement arrangements for use with the connection arrangement. Specifically, a connection arrangement 106 in FIG. 15 provides joints 108, 110, with two link members 50*a,* 50*b* being fastened with a single bolt 80 and nut 82 to compress springs 64, 66 so as to provide desirable contact forces when the conductor 100 engages the joint 20 or 22.

Figure 16:
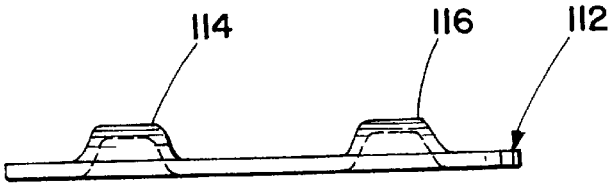
FIGS. 16 and 17 are respective front and right-side elevational views of a link member for a connection arrangement in accordance with a fourth embodiment of the present invention.
Figure 17:
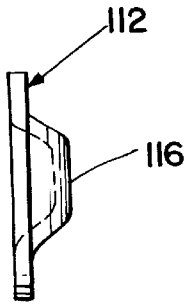

In accordance with other aspects of the present invention and referring additionally now to FIGS. 16 and 17, a fourth embodiment of the present invention utilizes a link member 112 in lieu of the link member 50. The link member 112 includes protuberances 114, 116 which are generally elongated convexities. The link member 112 illustrates how the present invention may be practiced with various configurtions of joints which are other than generally spherical. While the embodiment of FIGS. 7–9 may be preferable for situations where greater degrees of freedom are desired or required, the embodiment of FIGS. 16–17 provides a useful separable flexible connection.

While there have been illustrated and described various embodiments of the present invention, it will be apparent that various changes and modifications will occur to those skilled in the art. Accordingly, it is intended in the appended claims to cover all such changes and modifications that fall within the true spirit and scope of the present invention.

What is claimed and desired to be secured by Letters Patent of the United States is:

1. An externally removable, separable bushing connector for providing an electrical connection through a wall comprising:

an insulating portion;

a first conductor extending through said insulating portion;

means for fastening said insulating portion to the wall; and connection means carried by said first conductor for receiving predetermined portions of a second conductor adapted to interfit with and connect to said connection means, said connection means comprising flexible connection means for relative movement between said first and second conductors when connected, said predetermined portions of said second conductor including an elongated open-ended slot, said flexible connection means further comprising two protuberances arranged to face each other, whereby connection is effected by engagement of said two protuberances of said flexible connection means and said open-ended slot via relative movement between said first and second conductors.

2. The bushing connector of claim 1, wherein said flexible connection means comprises a connection joint formed by two protuberances arranged to face each other.

3. The bushing connector of claim 2 wherein said protuberances are generally spherical.

4. The bushing connector of claim 2 wherein said flexible connection means further comprises means for providing compressive contact force at said connection joint.

5. The bushing connector of claim 4 further comprising non-conductive means for defining an end stop for said second conductor at said generally spherical joint.

6. The bushing connector of claim 1 wherein said elongated open-ended slot is arcuately shaped.

7. An externally removable, separable bushing connector for providing an electrical connection through a wall to a first conductor comprising:

an insulating portion;

a second conductor extending through said insulating portion;

means for fastening said insulating portion to the wall; and connection means carried by one of the first conductor or said second conductor for receiving predetermined portions of the other conductor which is adapted to interfit with and connect to said connection means, said connection means comprising flexible connection means for relative movement between said first and second conductors when connected, said predetermined portions of said other conductor including oppositely facing grooves, one on each side thereof, whereby connection is effected along said grooves via relative movement between the first conductor and said second conductor.

* * * * *